US008820841B2

(12) United States Patent
Donley

(10) Patent No.: US 8,820,841 B2
(45) Date of Patent: Sep. 2, 2014

(54) RACQUET CHAIR

(76) Inventor: Erik Robert Donley, Minneapolis, MN (US)

( * ) Notice: Subject to any disclaimer, the term of this patent is extended or adjusted under 35 U.S.C. 154(b) by 251 days.

(21) Appl. No.: 13/451,900

(22) Filed: Apr. 20, 2012

(65) Prior Publication Data

US 2012/0267929 A1 Oct. 25, 2012

Related U.S. Application Data

(60) Provisional application No. 61/517,640, filed on Apr. 25, 2011.

(51) Int. Cl.
*A47C 4/03* (2006.01)

(52) U.S. Cl.
CPC ..... *A47C 4/03* (2013.01)
USPC ..... 297/440.13; 297/18; 297/181; 108/119; 248/432

(58) Field of Classification Search
USPC ..... 297/16.1, 17, 18, 33, 42, 181, 440.1, 297/440.13, 440.14; 108/119, 158.12, 108/158.16; 248/432
See application file for complete search history.

(56) References Cited

U.S. PATENT DOCUMENTS

| | | | | | |
|---|---|---|---|---|---|
| 176,392 | A | * | 4/1876 | Wirth | 108/101 |
| 216,629 | A | | 6/1879 | Powell | |
| 335,656 | A | | 2/1886 | Taylor | |
| 400,841 | A | | 4/1889 | Glocker | |
| 664,976 | A | | 1/1901 | Sheffy et al. | |
| 881,266 | A | | 3/1908 | Thompson et al. | |
| 2,164,631 | A | | 7/1939 | Abell | |
| 2,563,700 | A | * | 8/1951 | Wolf | 5/640 |
| 2,587,010 | A | * | 2/1952 | Thompson | 108/171 |
| 2,625,208 | A | | 1/1953 | Lee | |
| 2,629,429 | A | | 1/1953 | Baumfeld et al. | |
| 2,914,117 | A | * | 11/1959 | Underwood | 297/440.19 |
| 3,230,909 | A | | 1/1966 | Watson | |
| 3,262,405 | A | | 7/1966 | Sutton | |
| 3,338,189 | A | | 8/1967 | Xavier | |
| 3,427,074 | A | * | 2/1969 | Whyte | 297/440.19 |
| D218,421 | S | | 8/1970 | Crandall | |
| 3,547,491 | A | | 12/1970 | Bovasso | |
| 3,602,160 | A | * | 8/1971 | Heal | 108/119 |
| 3,861,746 | A | * | 1/1975 | Skinner | 297/440.19 |
| 4,077,668 | A | | 3/1978 | Puccinelli | |
| 4,094,505 | A | | 6/1978 | Beall, Jr. | |
| 4,190,001 | A | | 2/1980 | Cecala | |
| 4,379,554 | A | | 4/1983 | Schuyler et al. | |
| 4,544,203 | A | * | 10/1985 | Younger et al. | 297/391 |
| 4,592,287 | A | * | 6/1986 | Thygeson | 108/171 |
| 4,712,837 | A | | 12/1987 | Swilley | |
| 5,470,038 | A | | 11/1995 | Clark | |

(Continued)

*Primary Examiner* — Peter Brown
(74) *Attorney, Agent, or Firm* — Leanne Taveggia Farrell; Westman, Champlin & Koehler, P.A.

(57) ABSTRACT

A chair includes a first component resembling sporting equipment and including a head portion and a handle portion. The head portion is pivotable about a first axis located on the handle portion. The chair also includes a second component that is substantially identical to the first component and interconnects with the first component to form a chair. The second component also resembles sporting equipment and includes a head portion and a handle portion. The head portion of the second component is pivotable about a second axis located on the handle portion of the second component. When assembled, one of the head portion of the first component and the head portion of the second component forms a seat of the chair.

17 Claims, 13 Drawing Sheets

(56) References Cited

U.S. PATENT DOCUMENTS

| | | | | | |
|---|---|---|---|---|---|
| 5,584,254 | A | * | 12/1996 | Williams | 108/118 |
| 5,647,285 | A | * | 7/1997 | Steward | 108/119 |
| 5,690,379 | A | | 11/1997 | Cayssials | |
| 5,762,004 | A | | 6/1998 | Vashon et al. | |
| 5,813,721 | A | | 9/1998 | Arcidiacono | |
| 6,109,695 | A | | 8/2000 | Kahwaji | |
| 6,257,660 | B1 | | 7/2001 | Calvey | |
| D457,740 | S | | 5/2002 | Rosa | |
| D523,251 | S | | 6/2006 | Parpala | |
| D553,371 | S | | 10/2007 | Haskell | |
| 8,002,651 | B2 | | 8/2011 | Babolat | |
| 8,020,497 | B2 | | 9/2011 | Ossorguine | |

* cited by examiner

RACQUET CHAIR

CROSS-REFERENCE TO RELATED APPLICATION

The present application is based on and claims the benefit of U.S. provisional patent application Ser. No. 61/517,640, filed Apr. 25, 2011, the content of which is hereby incorporated by reference in its entirety.

BACKGROUND

Sporting competitions almost always include an allotted timeframe for rest. Tennis is one example where participants compete for a period of time and then take a break, such as between sets. In many sport competition venues, there are no places for the competitors or spectators to sit during their competition or during the break. Conventional chairs and stools are too big and bulky to carry around and other foldable chairs are not suitable.

The discussion above is merely provided for general background information and is not intended to be used as an aid in determining the scope of the claimed subject matter.

SUMMARY

A chair includes a first component resembling sporting equipment and including a head portion and a handle portion. The head portion is pivotable about a first axis located on the handle portion. The chair also includes a second component that is substantially identical to the first component and interconnects with the first component to form a chair. The second component resembles sporting equipment and includes a head portion and a handle portion. The head portion of the second component is pivotable about a second axis located on the handle portion of the second component. When assembled, the head portion of the first component or the head portion of the second component forms a seat of the chair.

The first component of the chair further includes an end, a foot bed and a connection slot and the second component of the chair further includes an end, a foot bed and a connection slot. The connection slot of the first component mates with the connection slot of the second component and the end of the first component mates with the foot bed of the second component and the end of the second component mates with the foot bed of the first component.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

FIG. 3-1 is an enlarged exploded view of the pivotal coupling between the head portion and the handle portion of one of the components illustrated in FIG. 1 under one embodiment.

FIG. 3-2 is an enlarged exploded view of the pivotal coupling between the head portion and the handle portion of one of the components illustrated in FIG. 1 under an alternative embodiment.

DETAILED DESCRIPTION

Embodiments described herein include a chair. When in a disassembled state, the chair includes two separate, yet substantially identical components. Each component resembles the shape of a racquet and likewise includes a handle portion and a head portion. Unlike a racquet used in sporting competitions, however, the head portions of each of the substantially identical components are pivotable about an axis located on the handle portions. When in an assembled state, the head portions of the two components of the chair are pivoted about the axes such that the head portions are oriented at an angle from the handle portions and the two components are interconnected together.

Figure 1:
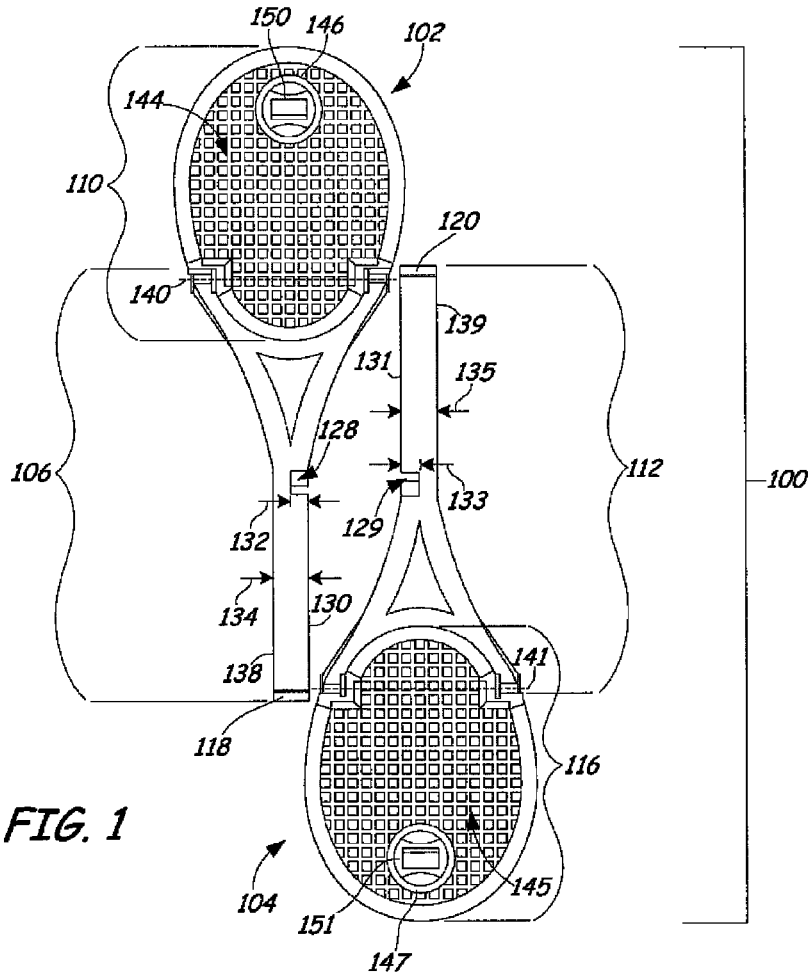
FIG. 1 is plan view of a pair of substantially identical components of a chair in a disassembled state.
Figure 2:
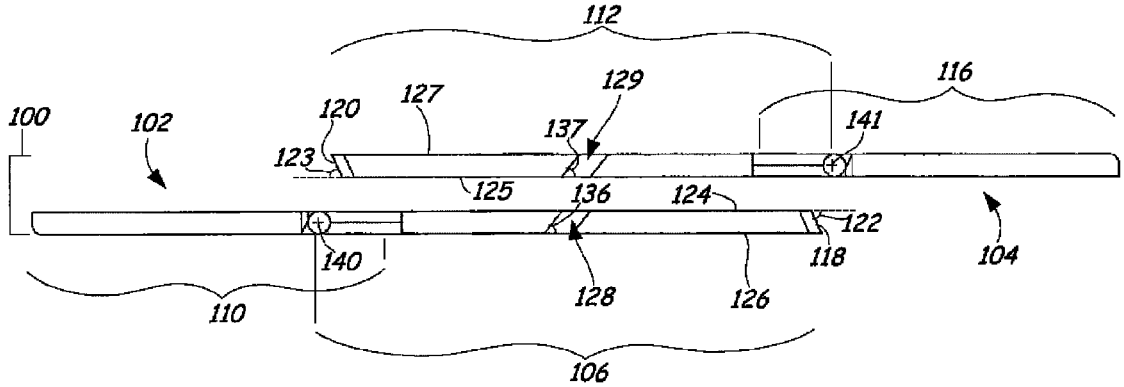
FIG. 2 is a side view of the pair of substantially identical components illustrated in FIG. 1.

FIG. 1 is a plan view of a pair of substantially identical components 102 and 104 of a chair 100 in a disassembled state. FIG. 2 is a side view of the pair of substantially identical components 102 and 104 in the disassembled state with their first surfaces 124 and 125 facing each other. As illustrated, first component 102 and second component 104 resemble a racquet including having a size, weight and shape that is substantially equivalent to a racquet. Therefore, in a disassembled state, first component 102 and second component 104 can fit into a racquet bag of a user. Substantially identical components 102 and 104 can be made of a variety of lightweight and durable materials, such as, but not limited to, carbon fiber, fiberglass, aluminum, graphite, various polymers and combinations thereof. For example, components 102 and 104 can be made of plastic having a fiberglass filler to strengthen the material. In addition, substantially identical components 102 and 104 can be made by injection molding, bladder molding, casting and the like.

First and second components 102 and 104 include handle portions 106 and 112 and head portions 110 and 116, respectively. Handle portion 106 is coupled to head portion 110 and handle portion 112 is coupled to head portion 116. While each component 102 and 104 is specific to the likeness of a tennis racquet, other embodiments can include likenesses of other types of racquets including, but not limited to, badminton racquets, squash racquets, racquetball racquets, table tennis paddles and pickle ball paddles. In further embodiments, components 102 and 104 can resemble other types of sporting equipment having two main portions (i.e. a head portion and a handle portion), such as golf clubs, baseball bats, hockey sticks and lacrosse sticks. In still further embodiments, just the handle portion or just the head portion can resemble different types of sporting equipment. For example, the head portion can resemble a home plate, while the handle portion may or may not resemble a baseball bat. In another example, the head portion can resemble a soccer ball, a baseball, a football, a basketball, a golf ball, a hockey puck and etc.

As illustrated in FIG. 2, handle portions 106 and 112 of first and second components 102 and 104 include an end 118 and 120. Rather than ends 118 and 120 being oriented substantially perpendicular to first surfaces 124 and 125 and opposing second surfaces 126 and 127 of handle portions 106 and 112 as is the case in an actual racquet, ends 118 and 120 are oriented at angles 122 and 123 that are less than 90 degrees from first surfaces 124 and 125 of handle portions 106 and 112. For example, angles 122 and 123 can range between 20 to 60 degrees from first surfaces 124 and 125.

First and second components 102 and 104 also include connection slots 128 and 129 located in handle portions 106 and 112, respectively. As readily illustrated in FIG. 1, connection slots 128 and 129 extend from one of first side surfaces 130 and 131 toward second side surfaces 138 and 139 of handle portions 106 and 112, respectively, and terminate a distance 132 and 133 from one of first side surfaces 130 and 131 that is less than a thickness 134 and 135 of handle portions 106 and 112, respectively. As readily illustrated in FIG. 2, each of connection slots 128 and 129 are oriented at angles 136 and 137 that are less than 90 degrees from second surfaces 126 and 127. For example, angles 136 and 137 can be approximately 51 degrees.

Figures 1, 3:
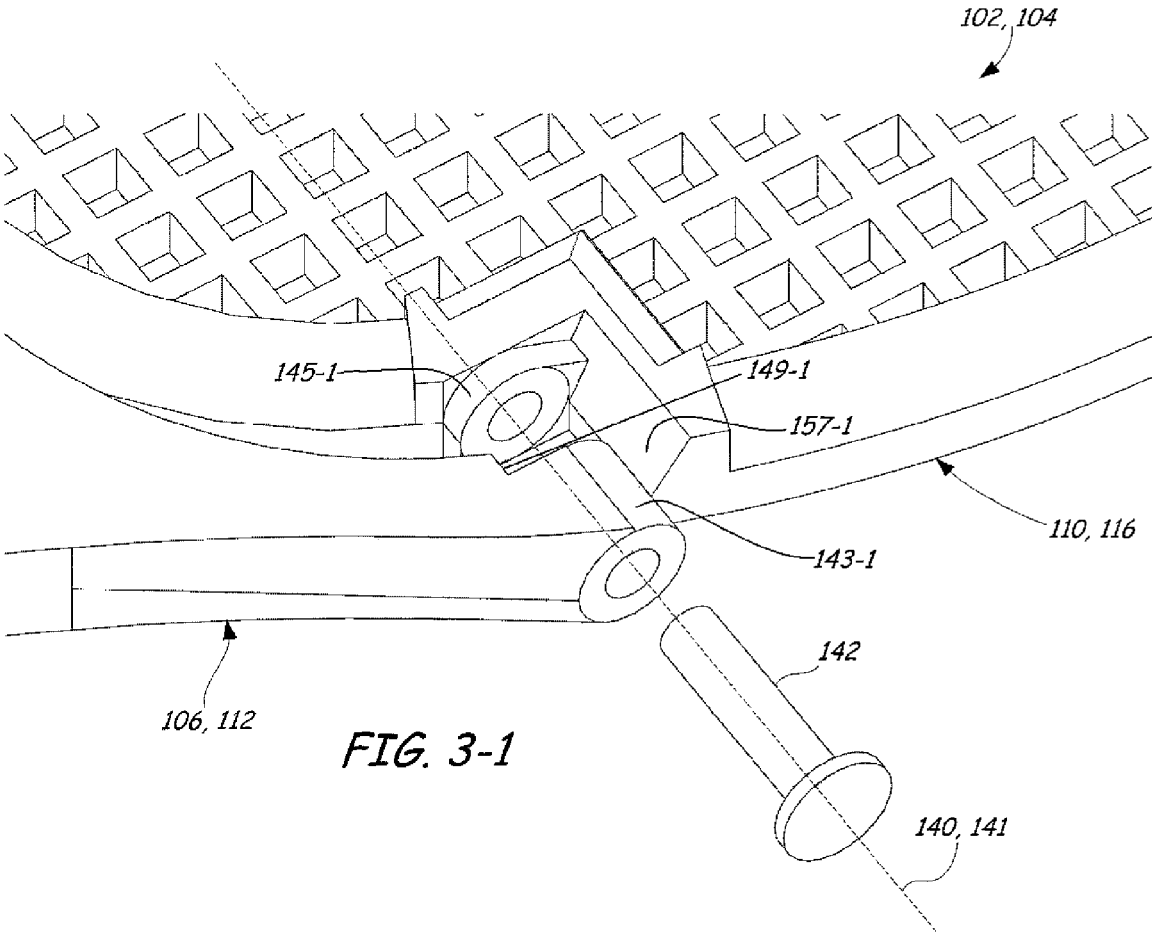
Figures 2, 3:
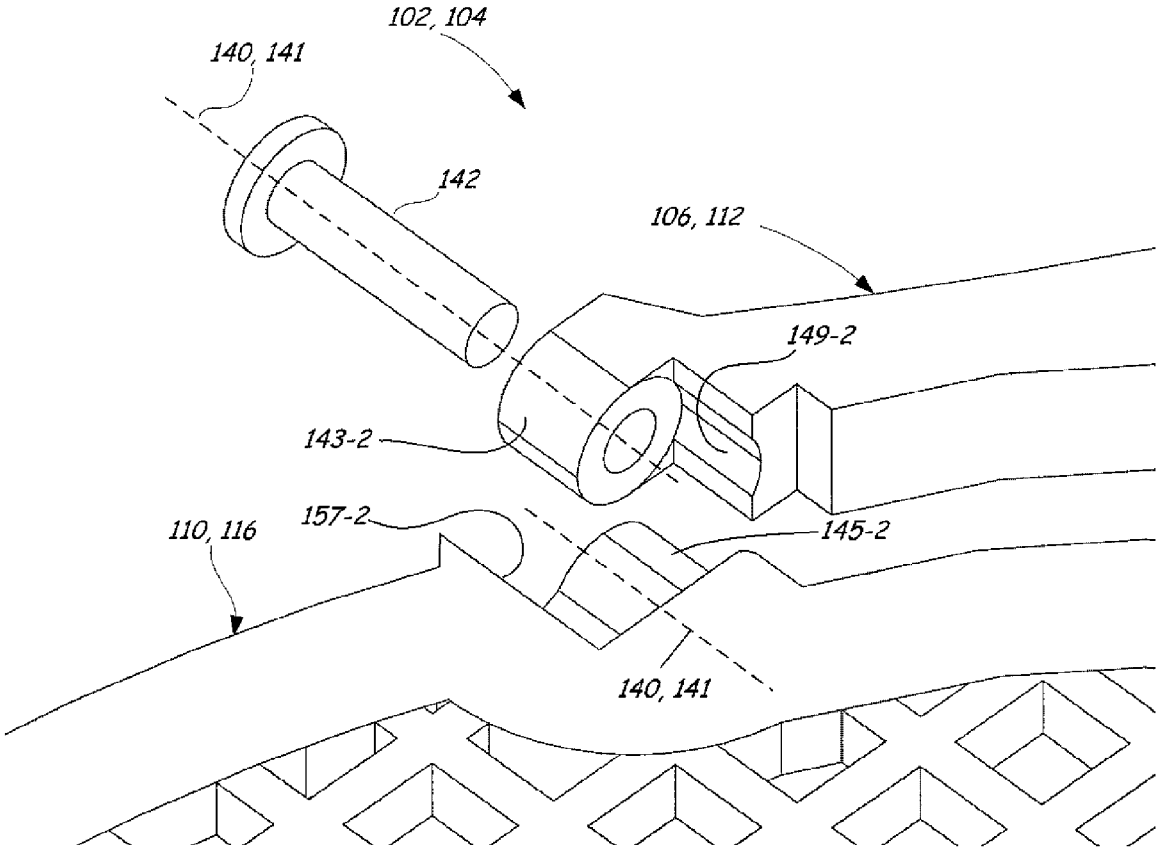

Head portion 110 of first component 102 is pivotably coupled to handle portion 106 about a first axis 140, which is located on handle portion 106. Likewise, head portion 116 of second component 104 is pivotably coupled to handle portion 112 about a second axis 141, which is located on handle portion 112. FIG. 3-1 illustrates an enlarged exploded view of one exemplary embodiment of the pivotable coupling between handle portions 106 and 112 and head portions 110 and 116. In particular, FIG. 3-1 illustrates a pin 142 that rotatably connects head portion 110 to handle portion 106 of first component 102 and rotatably connects head portion 116 to handle portion 112 of second component 104 along first and second axes 140 or 141. It should be realized, however, that other types of hinged mechanisms can be used other than that which is illustrated, for example hinge plates can be used.

More specifically and as illustrated in FIG. 3-1, handle portions 106 and 112 include a first collar 143-1 and head portions 110 and 116 include a second collar 145-1. First collar 143-1 aligns with second collar 145-1 and are coupled together using pin 142. Upon head portions 110 and 116 being rotated about handle portions 106 and 112, first collar 143-1 slidably engages with a first support surface 157-1 on head portions 110 and 116 and second collar 145-1 slidably engages with a second support surface 149-1 on handle portions 106 and 112.

FIG. 3-2 illustrates an enlarged exploded view of another exemplary embodiment of the pivotable coupling between handle portions 106 and 112 and head portions 110 and 116. In particular, FIG. 3-2 illustrates pin 142 rotatably connecting head portion 110 to handle portion 106 of first component 102 and rotatably connecting head portion 116 to handle portion 112 of second component 104 along first and second axes 140 and 141. More specifically, handle portions 106 and 112 include a first collar 143-2 and head portions 110 and 116 include a second collar 145-2. First collar 143-2 of handle portions 106 and 112 align with second collar 145-2 of head portions 110 and 116 and are coupled together using pin 142. Upon head portions 110 and 116 being rotated about handle portions 106 and 112, first collar 143-2 slidably engages with a first shoulder surface 157-2 on head portions 110 and 116 and second collar 145-2 slidably engages with a second shoulder surface 149-2 on handle portions 106 and 112. In FIG. 3-2, first shoulder surface 157-2 and second shoulder surface 149-2 have convex shapes so that the concave shape of first collar 143-2 slidably engages a large surface area of first shoulder surface 157-2 and the concave shape of second collar 145-2 slidably engages a large surface area of second shoulder surface 149-2. By matching the concave shape of the collars with the convex shape of the shoulders, the chair 100, when assembled, can better support the weight of a person sitting on thereon.

With reference back to FIG. 1, first and second components 102 and 104 further include foot beds 146 and 147, respectively. Foot bed 146 is located on a first surface 144 of head portion 110 and foot bed 147 is located on a first surface 145 of head portion 116. In the embodiment illustrated in FIG. 1, foot beds 146 and 147 are circular in shape and resemble a ball, such as a tennis ball. In other embodiments, though, where components 102 and 103 resemble other types of sporting equipment, foot beds can be of other types of sporting apparatus, such as golf balls, hockey pucks, baseball and etc. In addition, foot beds 146 and 147 include recesses 150 and 151, respectively. When chair 100 is in an assembled state, recess 150 is configured to receive end 120 of second component 104 and recess 151 is configured to receive end 118 of first component 102.

To assemble chair 100, first and second components 102 and 104 are oriented such that their handle portions 106 and 112 are extending in opposite directions from each other, first surfaces 144 and 145 and therefore foot beds 146 and 147 are facing in the same direction and the openings of connection slots 128 and 129 located at first side surfaces 130 and 131 are facing each other. Such a configuration is illustrated in FIG. 1.

Figure 4:
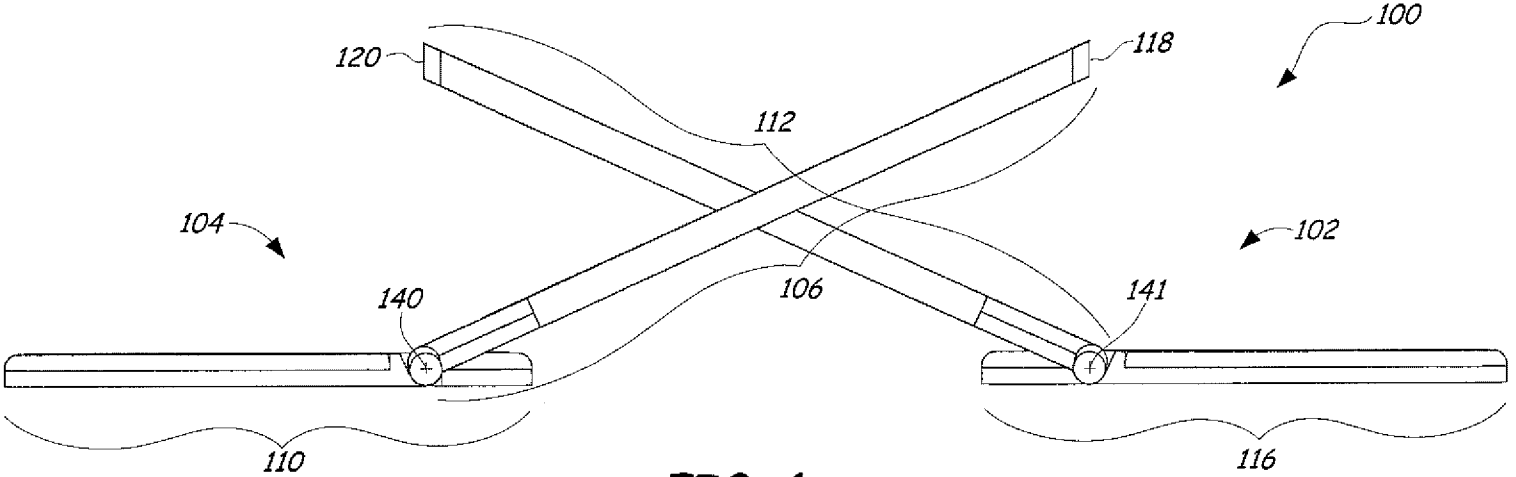
FIG. 4 a side view of a step in assembling the substantially identical components illustrated in FIG. 1 into the chair.

FIG. 4 is a side view of a step in assembling the substantially identical components 102 and 104 into chair 100. As illustrated, connection slots 128 and 129 (FIG. 1) are mated together such that handle portions 106 and 112 are interconnected. In this step, the terminating ends of each slot 128 and 129 touch each other such that handle portions 106 and 112 form an "X." In FIG. 4, this step additionally illustrates head portions 110 and 116 being pivoted about axes 140 and 141 located on handle portions 106 and 112 such that handle portions 106 and 112 are off the ground and head portions 110 and 116 are lying on the ground. In other embodiments, although not specifically illustrated, interconnecting connection slots 128 and 129 can be assembled off the ground and therefore head portions 110 and 116 would remain in alignment with handle portions 106 and 112.

Figure 5:
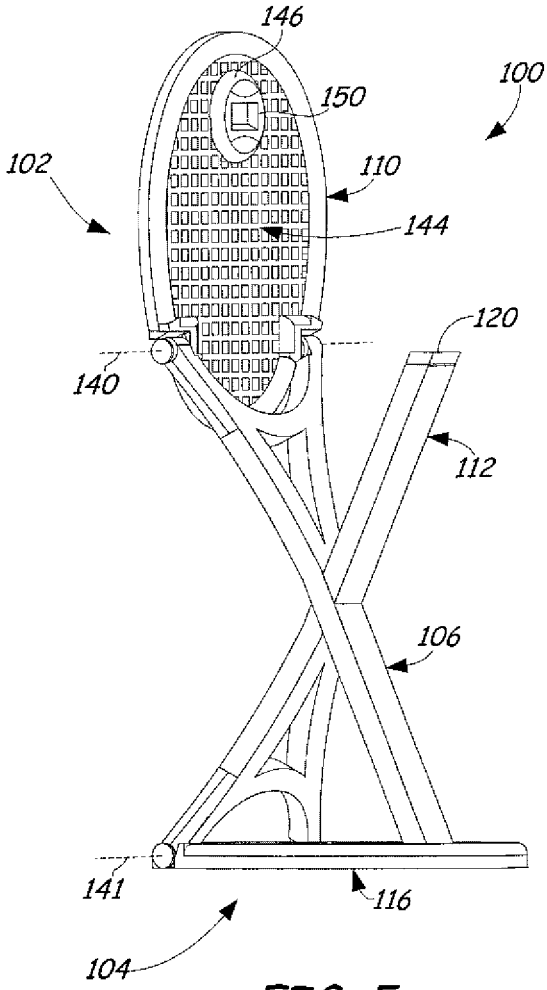
FIG. 5 is a perspective view of a further step in assembling the substantially identical components illustrated in FIG. 1 into the chair.
Figure 6:
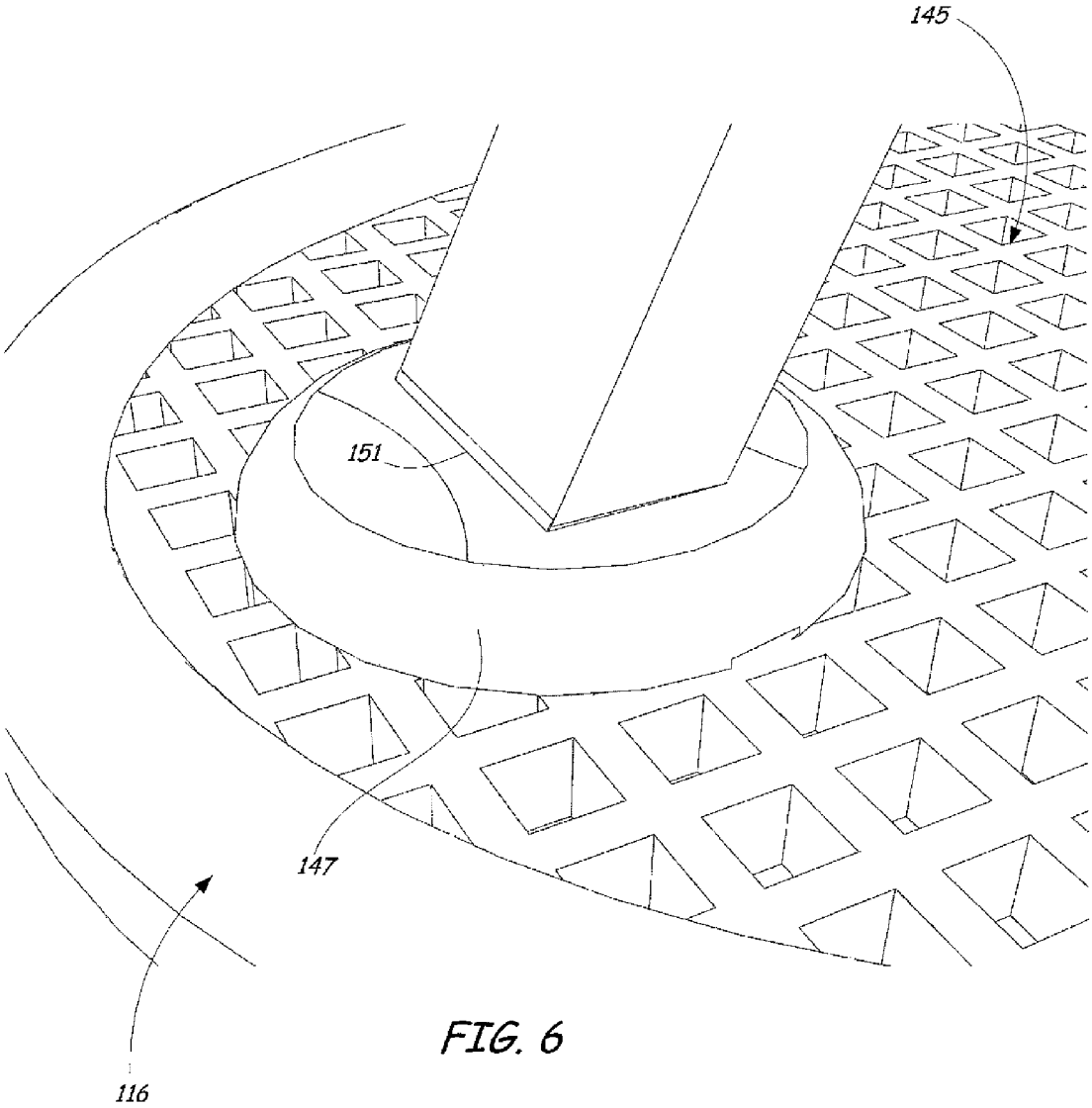
FIG. 6 illustrates an enlarged exploded view of an end of the first component inserted into a foot bed.
Figure 14:
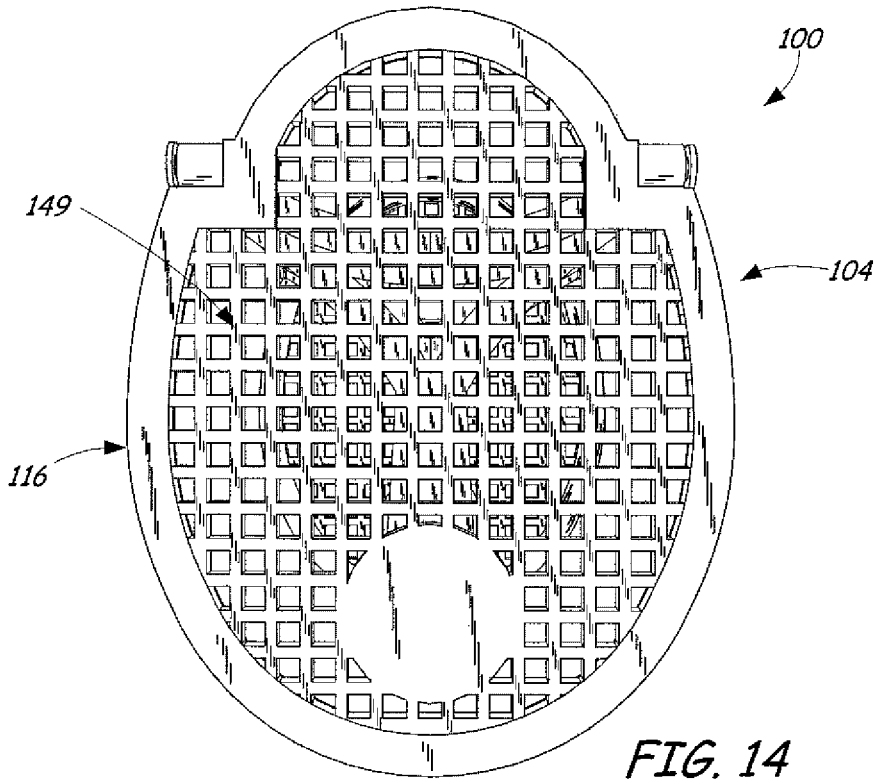
FIG. 14 is a bottom elevation view of the assembled racquet chair illustrated in FIG. 7.

FIG. 5 is a perspective view of a further step in assembling the substantially identical components 102 and 104 into chair 100. In FIG. 5, interconnected handle portions 106 and 112 are together rotated about second axis 141 located on handle portion 112 of second component 104 to insert or lock end 118 (FIGS. 1, 2 and 3) of first component 102 into recess 151 (FIG. 1) of foot bed 147 (FIGS. 1 and 8), which is located on first surface 145 (FIGS. 1 and 8) of head portion 116. In this way, end 118 forms a first foot of chair 100 and is received by recess 151 of foot bed 147. FIG. 6 illustrates an enlarged exploded view of end 118 inserted into foot bed 147. In this step of the assembly, first surface 145 of head portion 116 is configured to face upwards and an opposing second surface 149 (FIG. 14) is configured to face downwards.

Figure 13:
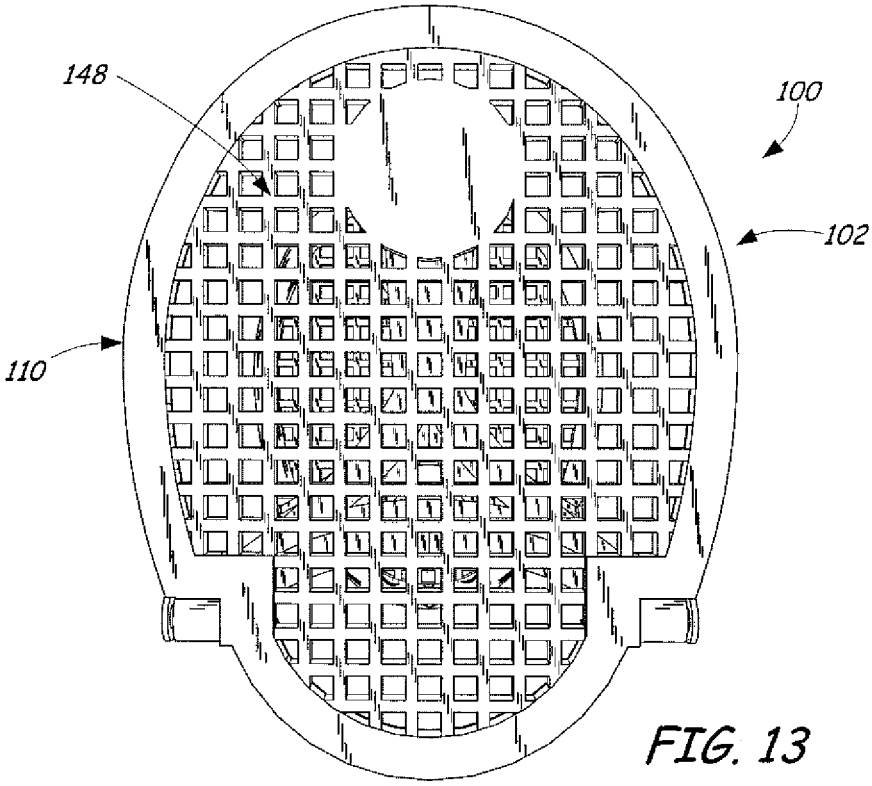
FIG. 13 is a top elevation view of the assembled racquet chair illustrated in FIG. 7.

In still a further step of assembling the substantially identical components illustrated in FIG. 1 into chair 100, head portion 110 is rotated or pivoted about first axis 140 located on handle portion 110 of first component 102 to insert or lock end 120 (FIGS. 1, 2, 3 and 5) of second component 104 into recess 150 of foot bed 146, which is located on first surface 144 of head portion 110. In this way, end 120 forms a second foot of chair 100 and is received by foot bed 146. At this point, chair 100 is in an assembled state and is ready to be used. In the assembled state, first surface 144 of head portion 110 is configured to face downwards and an opposing second surface 148 (FIG. 13) of head portion 110 is configured to face upwards.

Figure 7:
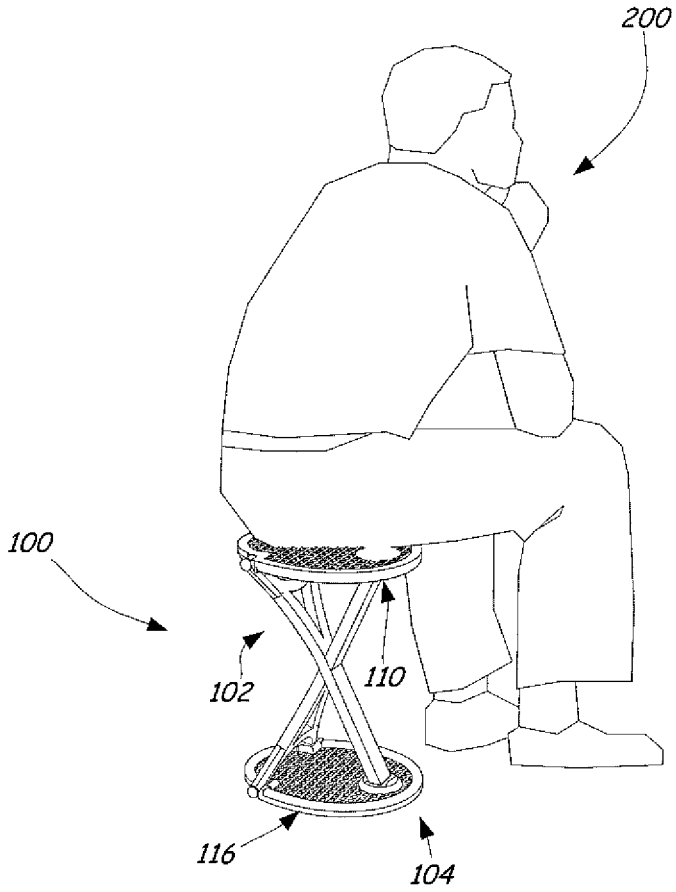
FIG. 7 is a perspective view of an exemplary assembled racquet chair supporting a user.

FIG. 7 is a perspective view of an exemplary assembled racquet chair 100 supporting a user 200. As illustrated, head portion 110 of first component 102 forms the seat of chair 100 and head portion 116 of second component 104 forms the base of chair 100. It should be realized, however, that chair 100 can be flipped over such that head portion 116 of second component 104 forms the seat of chair 100 and head portion 110 of first component 102 form the base of chair 100.

Figure 8:
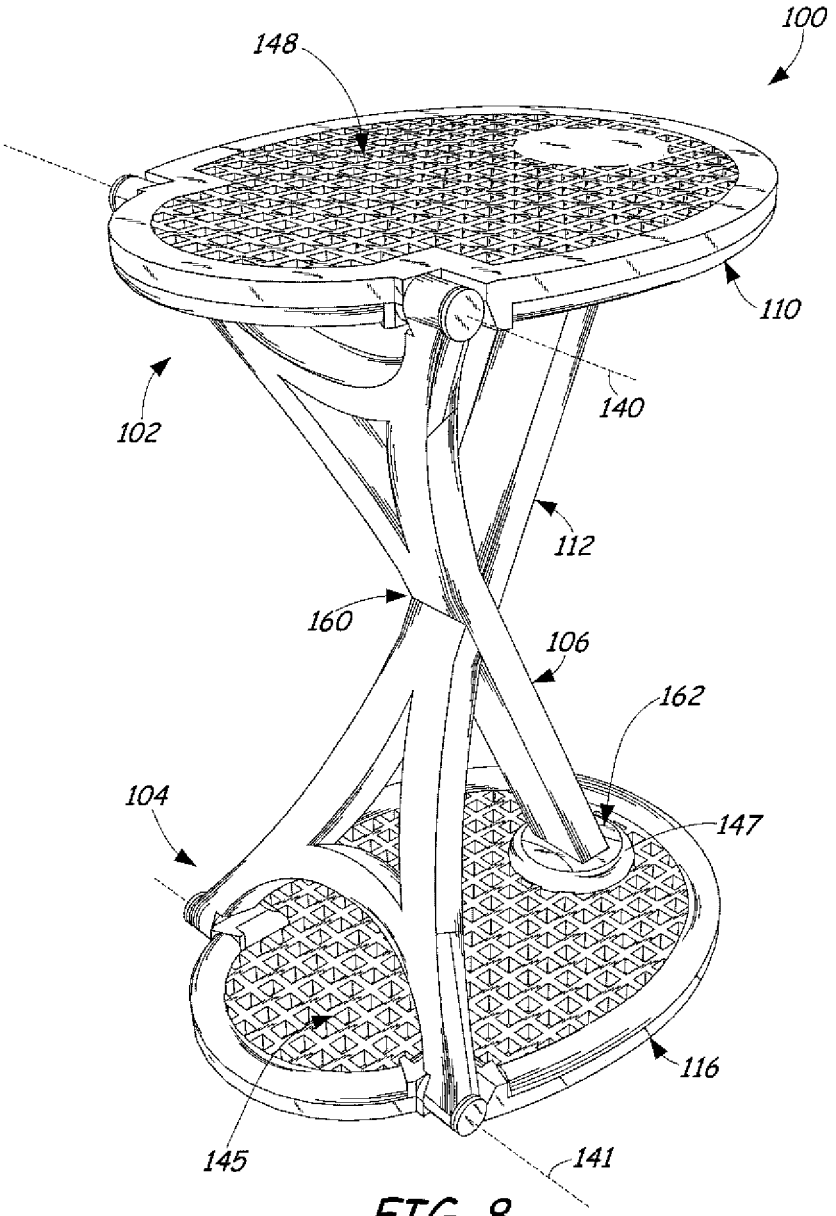
FIG. 8 is a back perspective view of the assembled racquet chair illustrated in FIG. 7.
Figure 9:
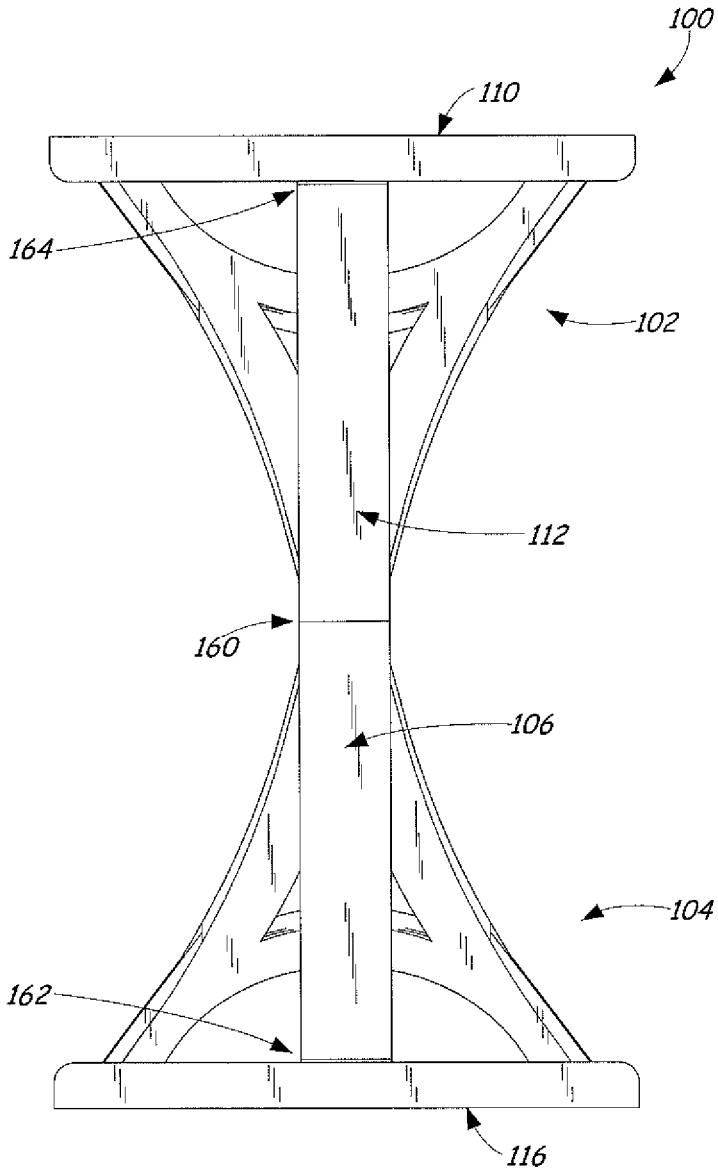
FIG. 9 is a front elevation view of the assembled racquet chair illustrated in FIG. 7.
Figure 10:
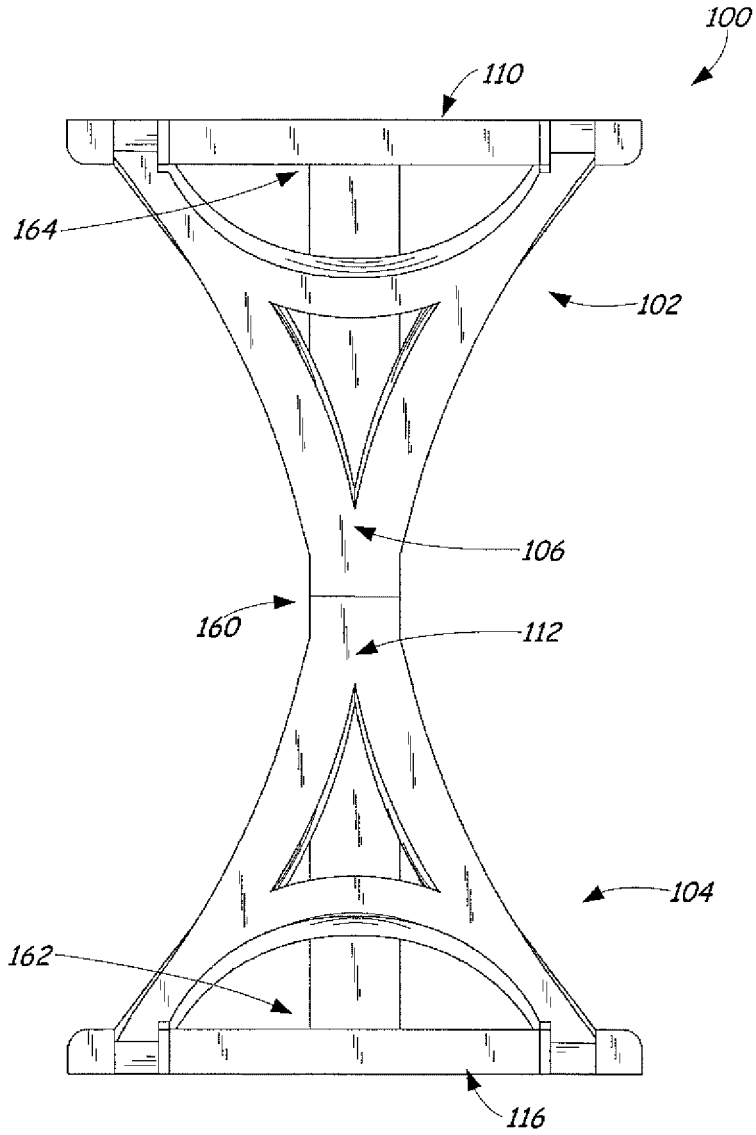
FIG. 10 is a back elevation view of the assembled racquet chair illustrated in FIG. 7.
Figure 11:
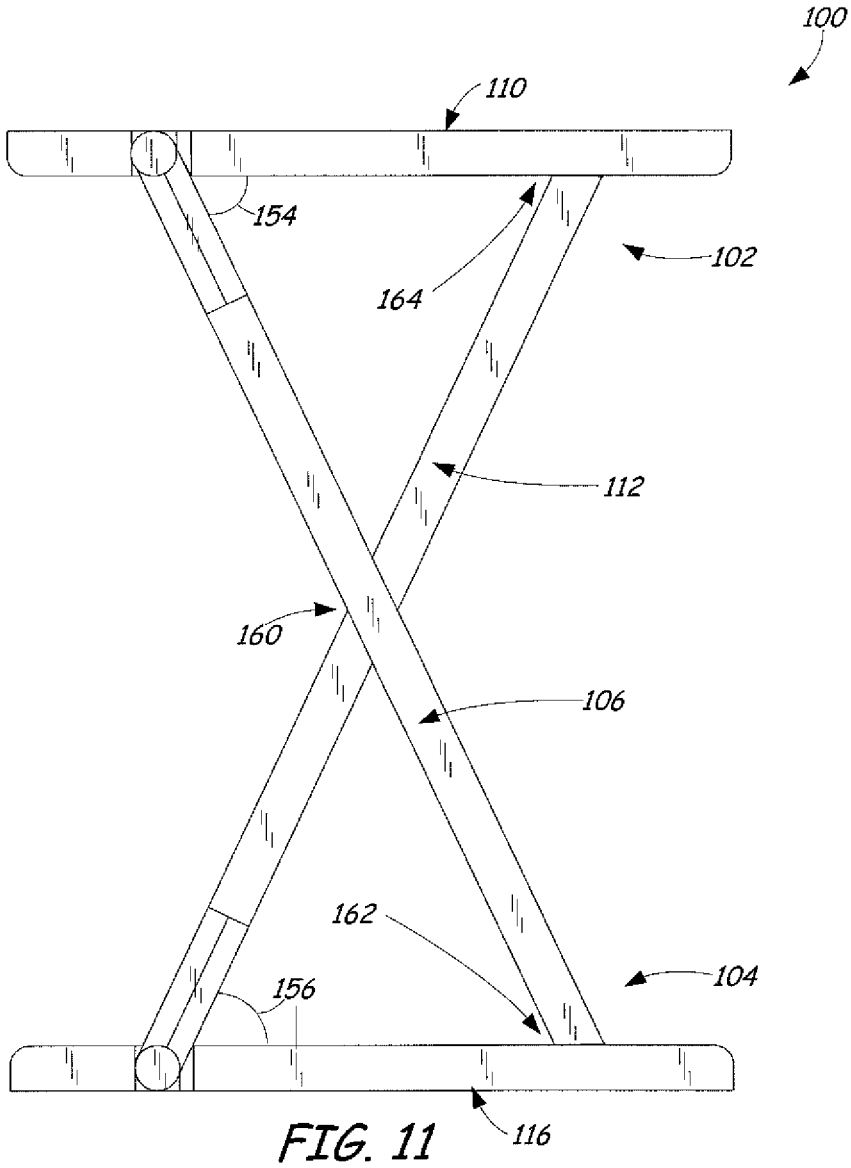
FIG. 11 is a left side elevation view of the assembled racquet chair illustrated in FIG. 7.
Figure 12:
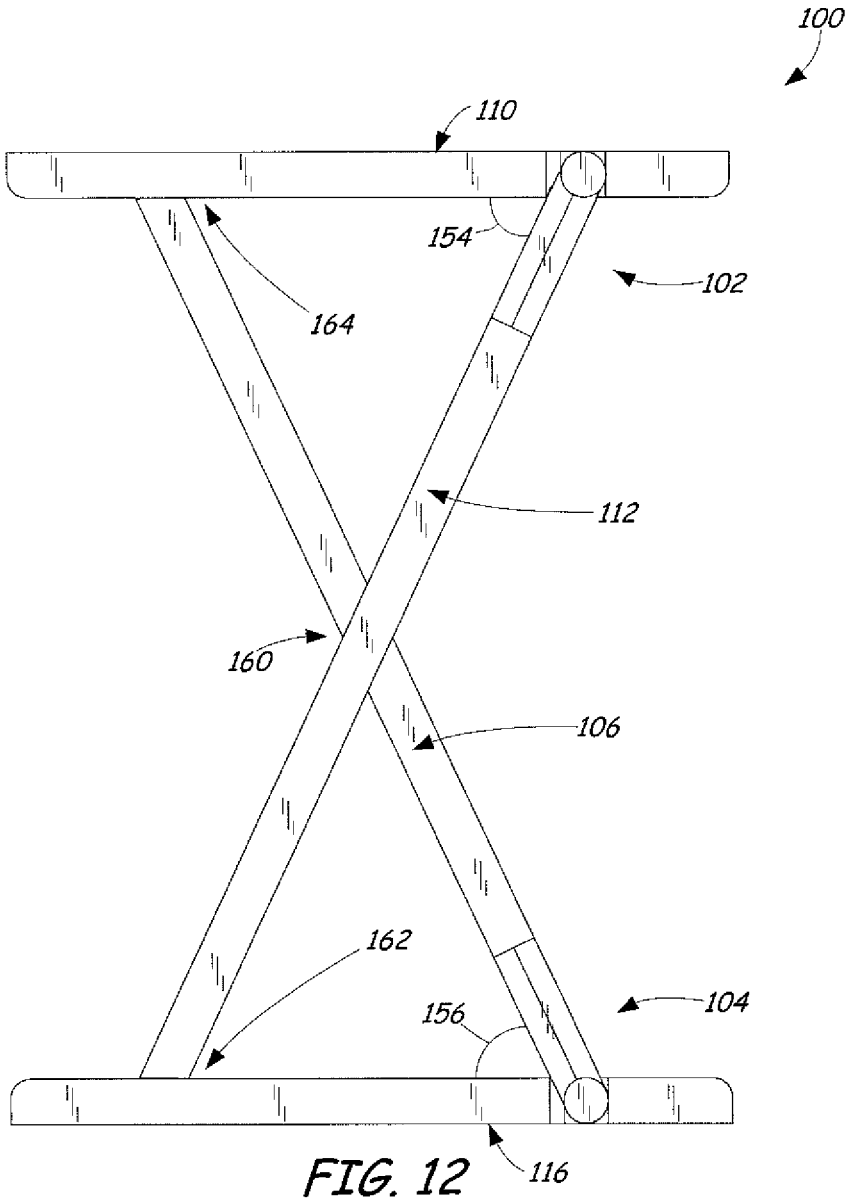
FIG. 12 is a right side elevation view of the assembled racquet chair illustrated in FIG. 7.

FIG. 8 illustrates a perspective view of chair 100 in an assembled state and FIGS. 9-14 illustrated elevation views of chair 100 in the assembled state including a front view, a back view, a right side view, a left side view, a top view and a bottom view. As illustrated, chair 100 includes first component 102 interconnected with second component 104 at three points of contact.

The first point of contact 160 includes the interconnection or mating of connection slot 128 (FIGS. 1 and 2) of first component 102 and connection slot 129 (FIGS. 1 and 2) of second component 104 along their handle portions 106 and 112. The second point of contact 162 includes the insertion of end 118 (FIGS. 1, 2 and 3) of first component 102 into recess 151 (FIGS. 1 and 6) of foot bed 147 (FIGS. 1, 6 and 8). The third point of contact 164 includes the insertion of end 120 (FIGS. 1, 2, 3 and 5) of second component 104 into recess 150 (FIGS. 1 and 5) of foot bed 146 (FIGS. 1 and 5).

When fully interconnected at the three points of contact 160, 162 and 164, chair 100 is in an assembled state. In an assembled state, first surface 144 (FIGS. 1 and 5) of head portion 110 is configured to face downwards and an opposing second surface 148 (FIGS. 8 and 13) is configured to face upwards. In addition, head portion 110 is pivoted about first axis 140 located on handle portion 106 such that the handle portion 106 is at an angle 154 from head portion 110 that is less than 90 degrees. Also in the assembled state, first surface 145 (FIGS. 1 and 8) of head portion 116 is configured to face upwards and an opposing second surface 149 (FIG. 14) is configured to face downwards. In addition, head portion 116 is pivoted about second axis 141 located on handle portion 112 such that the handle portion 112 is at an angle 156 from head portion 116 that is less than 90 degrees. In other words and in the assembled state, first surface 144 and therefore foot bed 146 of head portion 110 faces first surface 145 and therefore foot bed 147 of head portion 116

As previously described and as illustrated in FIGS. 8-12, head portion 110 of first component 102 forms the seat of chair 100 and head portion 116 of second component 104 forms the base of chair 100. However, chair 100 can be flipped over such that head portion 116 of second component 104 forms the seat of chair 100 and head portion 110 of first component 102 forms the base of chair 100. In this manner, chair 100 includes a versatile design that is appealing to both people participating in a sport event or people spectating at the sport event. In addition, the base of chair 100 will not sink into a court surface when a user sits on the chair. In times of hot weather, asphalt-type courts become soft and spongy. Any type of protrusion that bears weight can potentially penetrate the surface. The base of chair 100 disperses the weight of a user over a large surface area and therefore eliminates the potential for the chair 100 to sink into and ultimately destroy the court surface.

Chair 100 also gives athletes, such as tennis players, a competitive advantage during competition. In some cases, a court can get too hot to have chairs or benches placed on it and players are forced to sit on the hot court surface during breaks. Sitting on chair 100, the player will be cooler and better rested because the player has been able to sit in a more ergonomically correct position.

Still further, chair 100 can include printed indicia on surfaces of first component 102 and second component 104. In one embodiment, printed indicia can include marketing information including brand names of sporting equipment for advertising. Since chair 100 is eye-catching, interesting and functional, chair 100 presents a unique opportunity for advertising.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A chair comprising:

a first component including a head portion and a handle portion, wherein the head portion is pivotable about a first axis located on the handle portion and the handle portion includes a slot;

a second component being substantially identical to the first component and including a head portion and a handle portion, wherein the head portion of the second component is pivotable about a second axis located on the handle portion of the second component and the handle portion of the second component includes a slot;

wherein one of the head portions of the first component and the second component forms a seat of a chair;

wherein surfaces of the slot in the handle portion of the first component directly engage with surfaces of the slot in the handle portion of the second component so that the handle portions of the first and second components interlock and cross to form a non-pivotal leg support structure for the seat of the chair; and wherein the other of the head portions of the first component and the second component form a base for the leg support structure of the chair.

2. The chair of claim 1, wherein the slot in the handle portion of the first component extends from a first side surface to a second side surface and terminates a distance from the first side surface that is less than a thickness of the handle portion of the first component.

3. The chair of claim 2, wherein the slot in the handle portion of the first component is oriented at an angle from a front surface of the handle portion of the first component that is less than 90 degrees.

4. The chair of claim 2, wherein the slot in the handle portion of the second component extends from a first side surface to a second side surface and terminates a distance from the first side surface of the handle portion of the second component that is less than a thickness of the handle portion of the second component.

5. The chair of claim 4, wherein the slot in the handle portion of the second component is oriented at an angle from a front surface of the handle portion of the second component that is less than 90 degrees.

6. The chair of claim 1, wherein the handle portion of the first component comprises an end and the pivotable head portion of the first component comprises a foot bed located on a front surface of the head portion of the first component and wherein the handle portion of the second component comprises an end and the pivotable head portion of the second component comprises a foot bed located on a front surface of the head portion of the second component, wherein the head portion of the first component pivots about the first axis so that the foot bed of the first component receivably engages the end of the handle portion of the second component and wherein the head portion of the second component pivots about the second axis located on the handle portion of the second component so that the foot bed of the second component receivably engages the end of the handle portion of the first component.

7. The chair of claim 6, wherein the end of the handle portion of the first component is oriented at an angle from a front surface of the handle portion of the first component, and the end of the handle portion of the second component is oriented at an angle from a front surface of the handle portion of the second component, the angles of the end being less than 90 degrees.

8. A chair comprising:

a pair of substantially identical components that are interconnected to form a chair, wherein the first component includes a leg having an end, a seat having a foot bed and a slot located in the leg and wherein the second component includes a leg having an end, a base having a foot bed and a slot located in the leg of the second component;

wherein surfaces of the slot in the leg of the first component directly contact with surfaces of the slot in the leg of the second component to form a non-pivotal leg support structure that interlocks and crosses; and wherein the end of the leg of the first component mates with the foot bed on the seat of the second component and the end of the leg of the second component mates with the foot bed on the base of the first component.

9. The chair of claim 8, wherein the first component and the second component resemble racquets and include a head portion and a handle portion, wherein the foot beds of each of the first component and the second component are located on front surfaces of the head portions and the slots of each of the first component and the second component are located in the handle portions.

10. The chair of claim 9, wherein the head portion of the first component is pivotable about a first axis located on the handle portion of the first component and the head portion of the second component is pivotable about a second axis located on the handle portion of the second component.

11. The chair of claim 10, wherein the head portion of the first component is oriented at an angle relative to the handle portion of the first component that is less than 90 degrees when the chair is in an assembled state and the head portion of the second component is oriented at an angle relative to the handle portion of the second component that is less than 90 degrees when chair is in an assembled state.

12. The chair of claim 9, wherein the slot in the leg of the first component is oriented at an angle from a front surface of the handle portion of the first component that is less than 90 degrees and the slot in the leg of the second component is oriented at an angle from a front surface of the handle portion of the first component that is less than 90 degrees.

13. The chair of claim 9, wherein the slot in the leg of the first component extends from a first side surface to a second side surface of the handle portion of the first component and terminates a distance from the first side surface of the handle portion of the first component that is less than a thickness of the handle portion of the first component and wherein the slot in the leg of the second component extends from a first side surface to a second side surface of the handle portion of the second component and terminates a distance from the first side surface of the handle portion of the second component that is less than a thickness of the handle portion of the second component.

14. The chair of claim 9, wherein the end of the leg of the first component is oriented at an angle from a front surface of the handle portion of the first component, and the end of the leg of the second component is oriented at an angle from a front surface of the handle portion of the second component, the angles of the ends being less than 90 degrees.

15. A method of assembling a chair, the method comprising:

obtaining first and second separable components, the first and second components being substantially identical;

directly contacting surfaces of a slot located in a leg portion of the first component with surfaces of a slot located in a leg portion of the second component to form a non-pivotal leg support structure;

pivoting a head portion of the first component about a first axis located on the handle portion of the first component to lock an end of the leg portion of the second component into a foot bed located on the head portion of the first component; and pivoting a head portion of the second component about a second axis located on the handle portion of the second component to lock an end of the leg portion of the first component into a foot bed located on the head portion of the second component;

wherein one of the head portions of the first and second components form a seat of the chair and the other of the head portions of the first and second components form a base of the chair.

16. The method of claim 15, wherein the foot bed of the first component is located on a front surface of the head portion of the first component and the foot bed of the second component is located on a front surface of the head portion of the second component.

17. The method of claim 16, wherein pivoting the head portions of the first component and the second component comprises pivoting the head portions of the first component and the second component such that the foot bed on the front surface of the head portion of the first component faces the foot bed on the front surface of the head portion of the second component.

* * * * *